US010337523B2

(12) United States Patent
Chou

(10) Patent No.: US 10,337,523 B2
(45) Date of Patent: Jul. 2, 2019

(54) AIR BLOWER

(71) Applicant: Shu-Hsien Chou, New Taipei (TW)

(72) Inventor: Shu-Hsien Chou, New Taipei (TW)

( * ) Notice: Subject to any disclaimer, the term of this patent is extended or adjusted under 35 U.S.C. 154(b) by 0 days.

(21) Appl. No.: 15/876,418

(22) Filed: Jan. 22, 2018

(65) Prior Publication Data

US 2018/0223864 A1 Aug. 9, 2018

(30) Foreign Application Priority Data

Feb. 7, 2017 (TW) ..... 106103954 A

(51) Int. Cl.

| | |
|---|---|
| ***F04F 5/16*** | (2006.01) |
| ***F04F 5/46*** | (2006.01) |
| ***F04D 17/16*** | (2006.01) |
| ***F04D 25/06*** | (2006.01) |
| ***F04D 25/08*** | (2006.01) |
| ***F04D 25/16*** | (2006.01) |
| ***F04D 29/42*** | (2006.01) |
| ***F04D 29/66*** | (2006.01) |

(52) U.S. Cl.

CPC ..... *F04D 29/4213* (2013.01); *F04D 17/16* (2013.01); *F04D 25/0606* (2013.01); *F04D 25/08* (2013.01); *F04D 25/166* (2013.01); *F04D 29/4226* (2013.01); *F04D 29/667* (2013.01); *F04F 5/16* (2013.01); *F04F 5/46* (2013.01)

(58) Field of Classification Search

CPC ..... F04D 29/54; F04D 29/541; F04D 19/002; F04D 19/00

USPC ..... 415/208

See application file for complete search history.

(56) References Cited

U.S. PATENT DOCUMENTS 4,362,090 A * 12/1982 Whiteley ..... F24F 3/16 126/113

2018/0023582 A1* 1/2018 Park ..... F04D 25/06 417/44.1

FOREIGN PATENT DOCUMENTS

KR 20-1986-0013533 * 11/1986

KR 10-2016-0092154 * 1/2018 ..... 417/44.1

* cited by examiner

*Primary Examiner* — Nathaniel E Wiehe

*Assistant Examiner* — David Whittaker

(74) *Attorney, Agent, or Firm* — Guice Patents PLLC

(57) ABSTRACT

An air blower comprises an outer housing and an inner shell body. The outer housing is formed with at least one first suction inlet and at least one second suction inlet, a first high-pressure generation part having a first fan for forming a first high-speed airflow and a first discharge outlet are formed between the outer housing and the inner shell body, and a first airflow passage is defined by the first suction inlet, the first high-pressure generation part and the first discharge outlet; and the inner shell body includes a second high-pressure generation part having a second first fan for forming a second high-speed airflow, the front end of the inner shell body is formed with a second discharge outlet, and a second airflow passage spaced from the first airflow passage is defined by the second suction inlet, the second high-pressure generation part and the second discharge outlet.

13 Claims, 8 Drawing Sheets

B-B

A-A

B-B

AIR BLOWER

BACKGROUND OF THE INVENTION

1. Field of the Invention

The present invention relates to an air blower, especially to an air blower having two active airflow passages.

2. Description of Related Art

An air blower used for generating an air circulation and airflows is a well-known prior art. For example, an air blower is disclosed in China Patent No. CN104204543B (equivalent to PCT No. WO2013/140739JA) and used for generating the air circulation and airflows.

The above-mentioned air blower includes a housing; at least one suction opening, used for sucking air from the exterior of the housing; a high-pressure air generation section, having an impeller capable of enabling the air to be formed as high-pressure air and a motor used for driving the impeller; an annular discharge opening, used for discharging the high-pressure air; a first airflow passage, used for guiding the high-pressure air from the impeller to the discharge opening; a plurality of induction air suction openings, used for inducing the air through the high-pressure air discharged from the discharge opening; an induction air mixing section, used for mixing the air induced by the induction air suction openings; an induction air discharge opening, used for discharging the induced air of the induction air mixing section; and a second airflow passage, used for connecting the induction air suction openings, the induction air mixing section and the induction air discharge opening.

As such, when the motor inside the high-pressure air generation section is served to drive the impeller to rotate, the generated high-pressure air is discharged from the annular discharge opening, so that an active high-speed airflow is formed, the high-pressure air is served to induce air outside the housing, the air is induced from the induction air suction openings and mixed in the induction air mixing section then discharged from the induction air discharge opening, thereby forming a passive low-speed airflow.

When the annular active high-speed airflow and the columnar passive low-speed airflow are both driven to flow, the displaced distance of the annular active high-speed airflow and that of the columnar passive low-speed airflow are different because the two airflows have different flowing speeds, so that an anticipated cooling effect is hard to be achieved in a remote area, thus the above-mentioned disadvantage shall be improved.

SUMMARY OF THE INVENTION

One primary objective of the present invention is to provide an air blower, in which an inner shell body is disposed inside an outer housing, a first airflow passage and a second airflow passage spaced from each other and not interfering with each other are respectively formed between the outer housing and the inner shell body, the first airflow passage having a first high-pressure generation part is able to generate an active first high-speed airflow, the second airflow passage having a second high-pressure generation part is able to generate an active second high-speed airflow, the active first high-speed airflow and the active second high-speed airflow can overcome a shortage of a passive low-speed airflow having overly short displaced distance, thereby enhancing the air circulation and air flowing effects.

For achieving said objective, one technical solution provided by the present invention is to provide an air blower, which comprises an outer housing and an inner shell body disposed inside the outer housing; the outer housing is formed with at least one first suction inlet and at least one second suction inlet used for sucking external air into the interior of the outer housing, a first high-pressure generation part is formed between the outer housing and the inner shell body, the first high-pressure generation part has a first fan capable of enabling the air to be formed as a first high-speed airflow, and an electric machine used for driving the first fan for operation, and the first fan is connected to one end of an output shaft of the electric machine; an annular first discharge outlet allowing the first high-speed airflow to be discharged is formed between the outer housing and the inner shell body, and a first airflow passage is defined by the first suction inlet, the first high-pressure generation part and the first discharge outlet; and the inner shell body includes a second high-pressure generation part communicated with the second suction inlet, the second high-pressure generation part has a second fan capable of enabling the air to be formed as a second high-speed airflow, and the second fan is connected to another end of the output shaft of the electric machine; the front end of the inner shell body is formed with an annular second discharge outlet allowing the second high-speed airflow to be discharged, and a second airflow passage spaced from the first airflow passage is defined by the second suction inlet, the second high-pressure generation part and the second discharge outlet.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Please refer from FIG. 1 to FIG. 6, an air blower comprising an outer housing 1 and an inner shell body 2 disposed inside the outer housing 1 is disclosed by the present invention.

Figure 1:
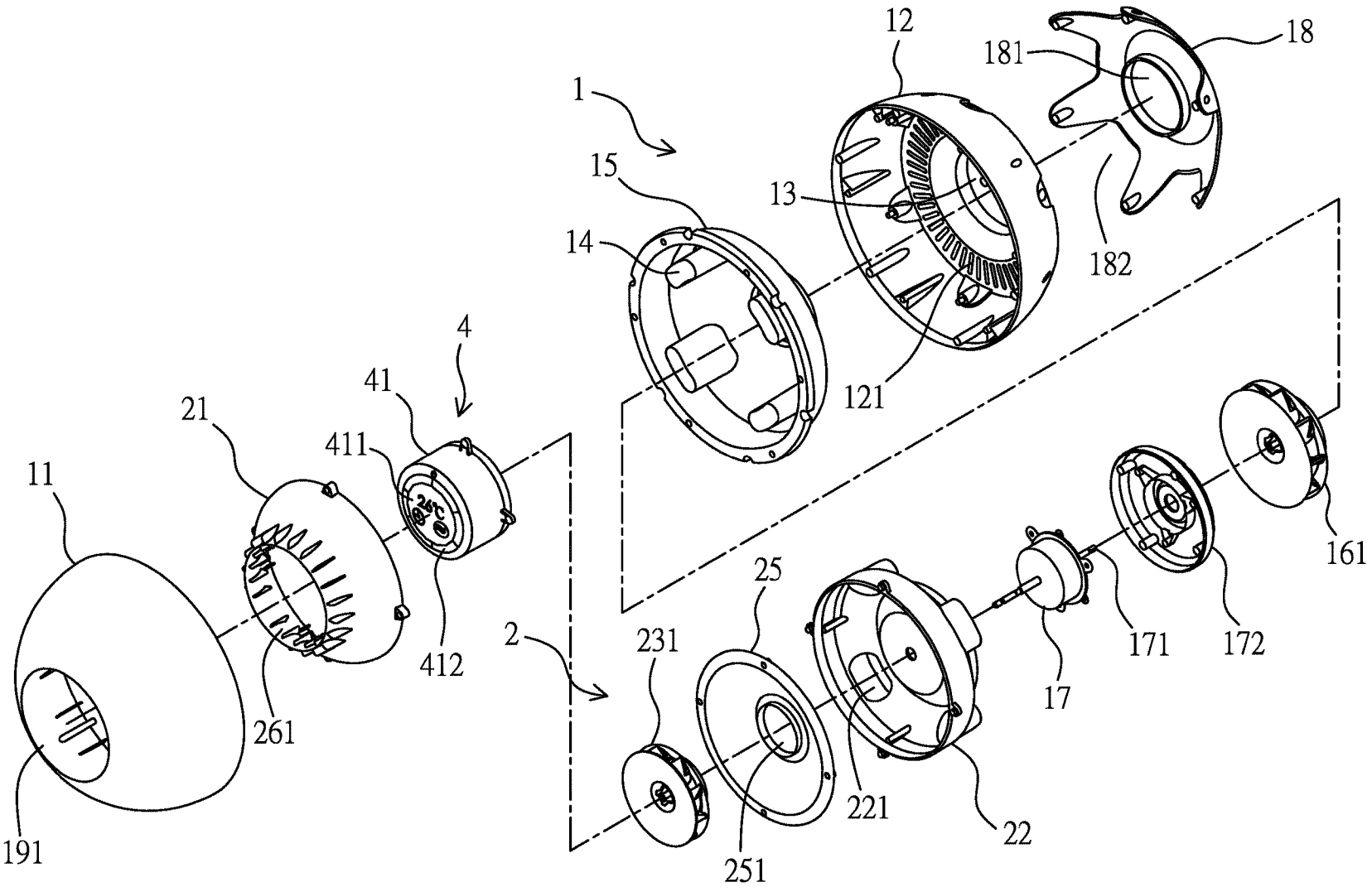
FIG. 1 is a perspective exploded view showing the air blower according to the present invention.
Figure 2:
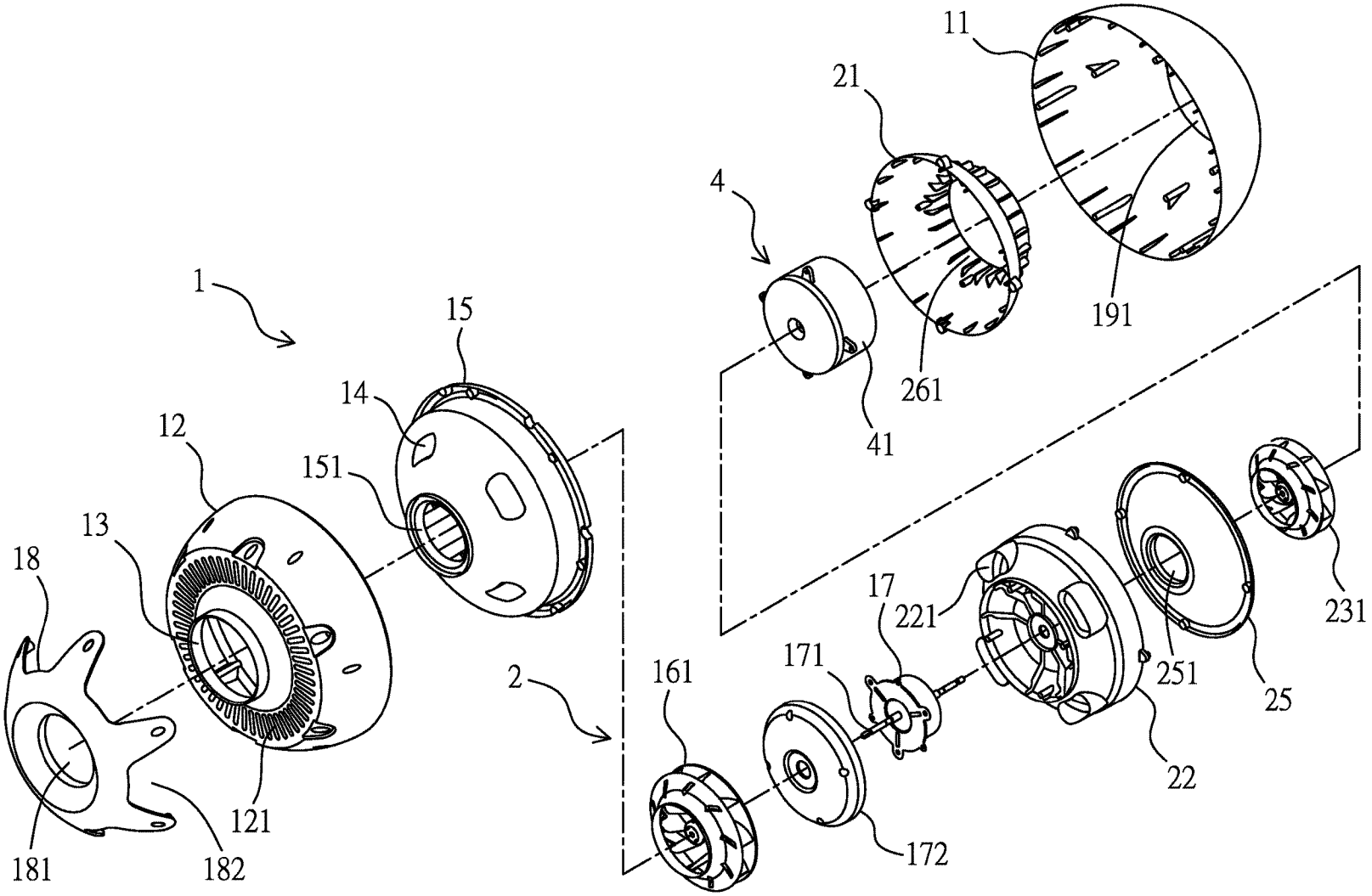
FIG. 2 is a perspective exploded view taken from another angle showing the air blower according to the present invention.
Figure 3:
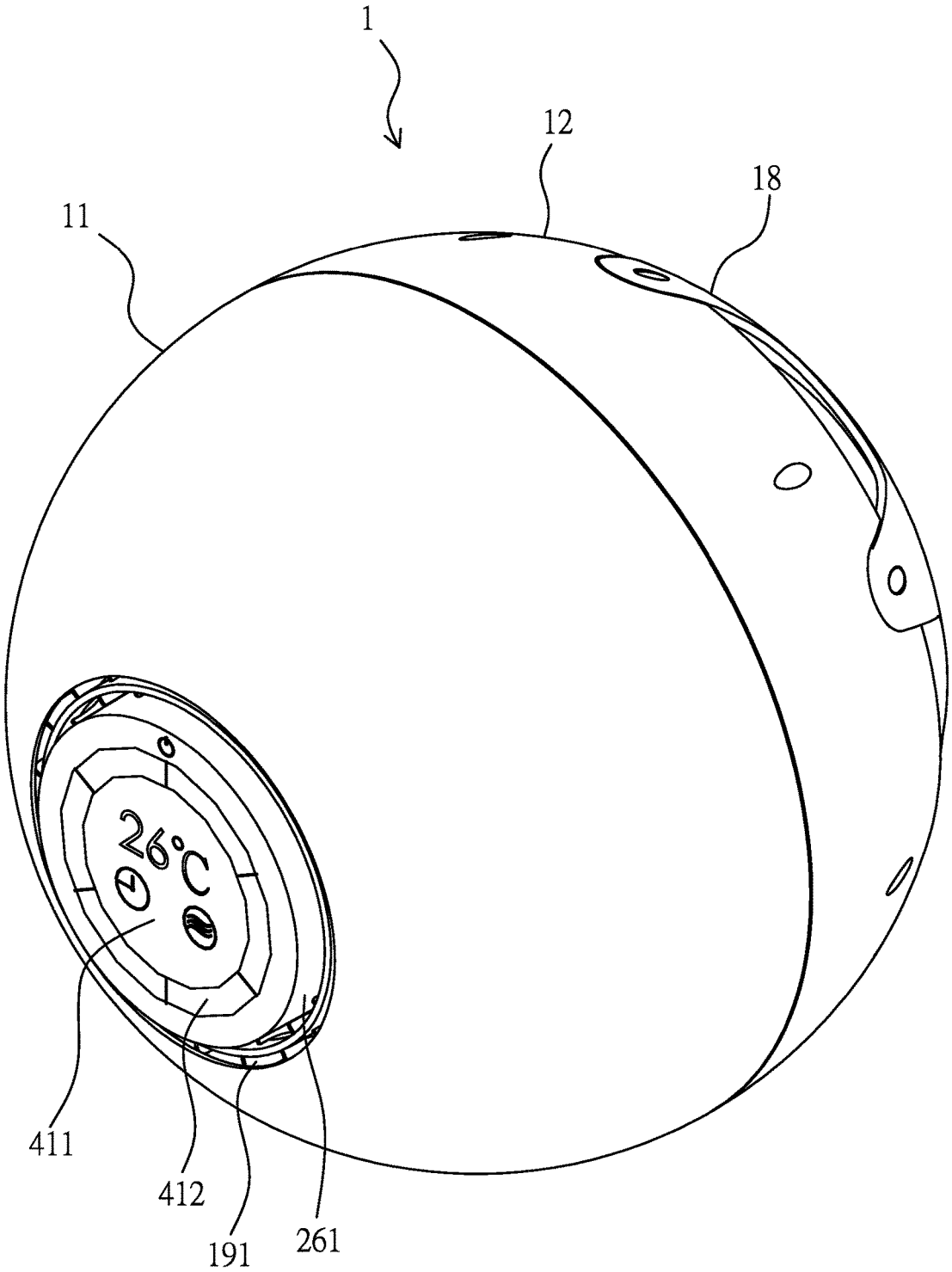
FIG. 3 is a perspective view showing the assembly of the air blower according to the present invention.
Figure 4:
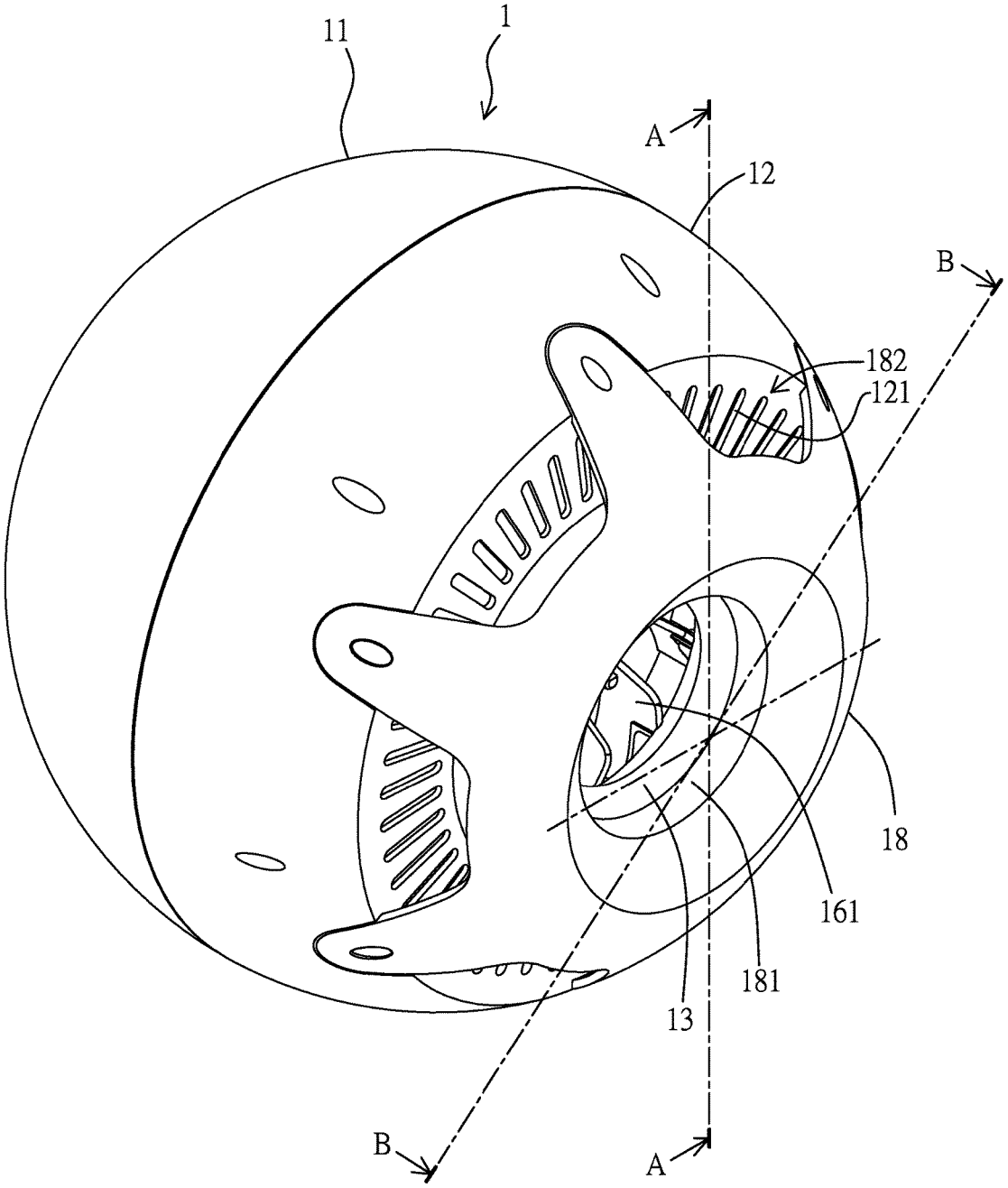
FIG. 4 is a perspective view taken from another angle showing the assembly of the air blower according to the present invention.
Figure 5:
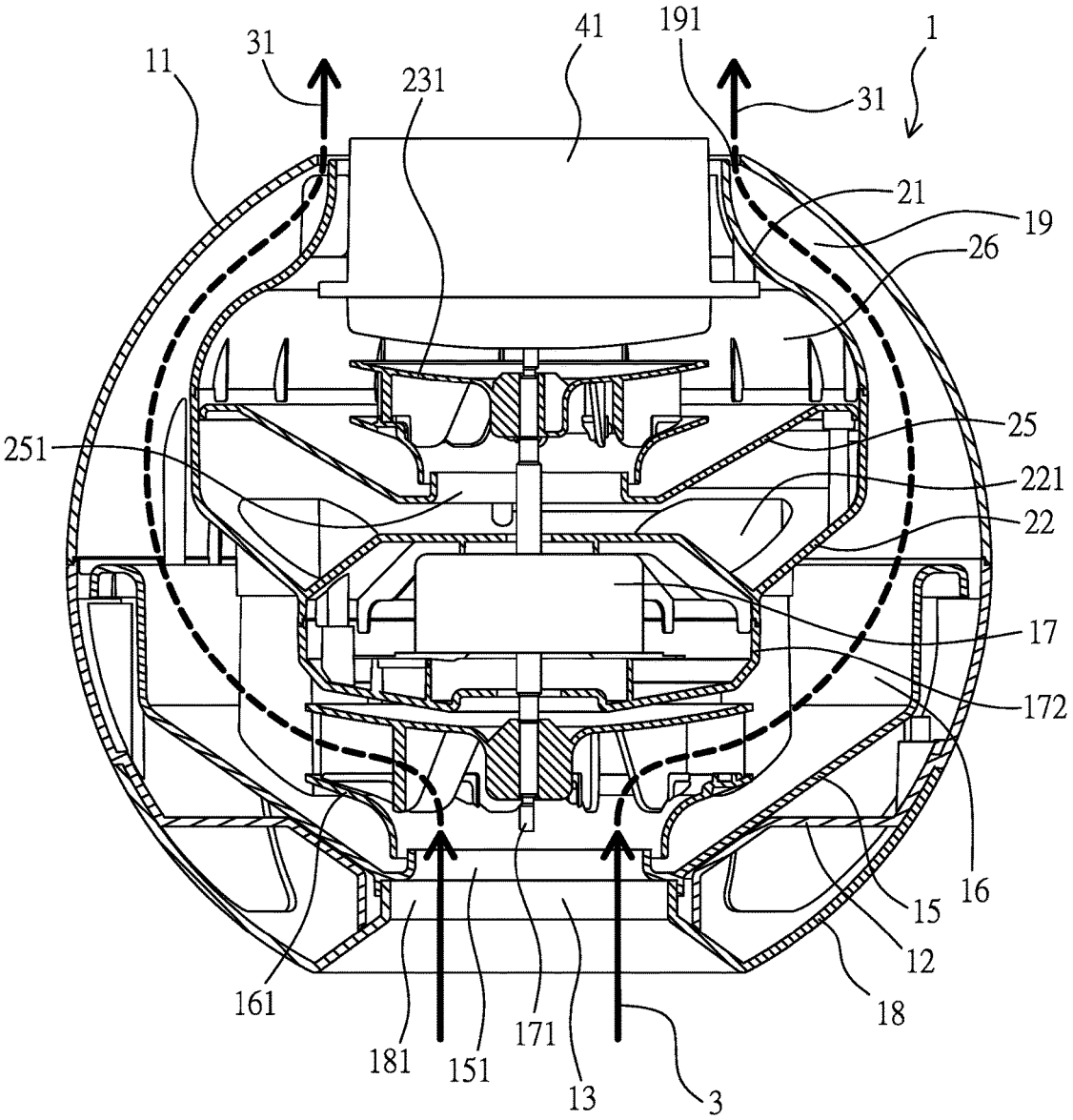
FIG. 5 is a cross sectional view of FIG. 4 taken along an A-A line.
Figure 6:
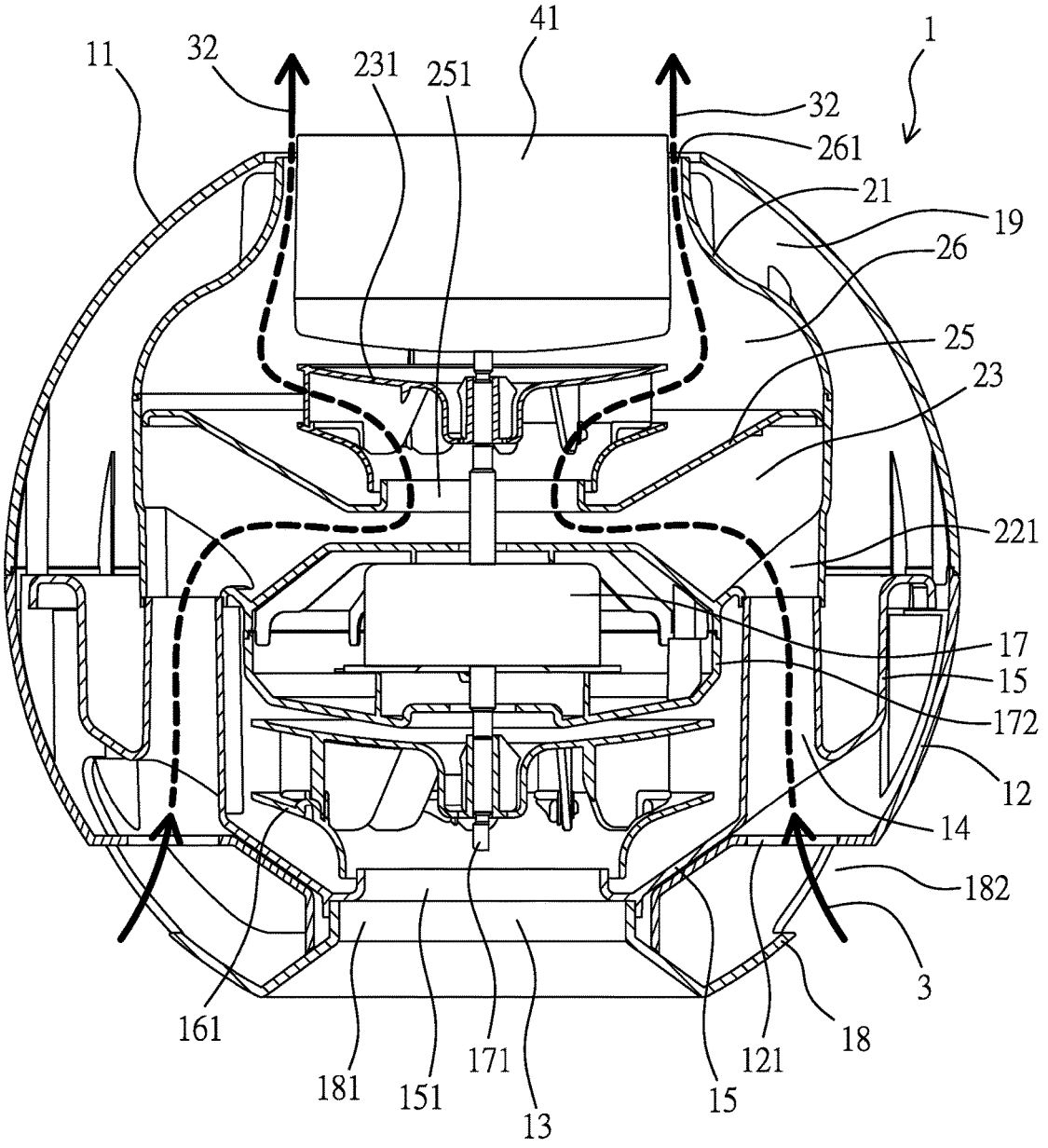
FIG. 6 is a cross sectional view of FIG. 4 taken along a B-B line.

The outer housing 1 is formed through a front housing 11 and a rear housing 12 being engaged so as to form a spherical body. The outer housing 1 is formed with at least one first suction inlet 13 and at least one second suction inlet 14, so that air 3 (shown in FIG. 5 and FIG. 6) outside the outer housing 1 can be sucked into the interior of the outer housing 1. As shown in FIG. 1 and FIG. 2, the at least one first suction inlet 13 is formed at the backside defined at the center of the rear housing 12, and the at least one second suction inlet 14 is formed at the outer periphery of a middle partition mask 15 disposed at the inner side of the rear housing 12.

The middle partition mask 15 is formed with at least one penetrated hole 151 corresponding to a location of the at least one first suction inlet 13 and communicated therewith and allowing the air 3 to pass, so that a first high-pressure generation part 16 (shown in FIG. 5) is formed in the outer housing 1, for example between the middle partition mask 15 and the inner shell body 2. The first high-pressure generation part 16 includes a first fan 161, for example an impeller or blades, used for enabling the air 3 to be formed as a first high-speed airflow 31 and an electric machine 17, for example a motor, used for driving the first fan 161 to be operated. The first fan 161 is connected to one end of an output shaft 171 of the electric machine 17. The rear housing 12 is formed with at least one first through hole 121 corresponding to a location of the at least one second suction inlet 14.

The rear surface of the rear housing 12 is further provided with an end cover 18, and the end cover 18 is formed with at least one first air inlet 181 and at least one second air inlet 182 respectively corresponding to locations of the at least one first suction inlet 13 and the at least one second suction inlet 14, so that the air 3 is allowed to smoothly pass the at least one first suction inlet 13 and the at least one second suction inlet 14 so as to enter the interior of the outer housing 1.

For being provided with an air filtering function, a filter, for example a filtering screen (known as a prior art so not shown in figures), is disposed between the end cover 18 and the rear housing 12, so that the air 3 entering the interior of the outer housing 1 can be filtered.

The inner shell body 2 is disposed inside the outer housing 1, so that an annular first discharge outlet 191 allowing the first high-speed airflow 31 to be discharged is formed between the outer housing 1 and the inner shell body 2, and a first airflow passage 19 (shown in FIG. 5) is defined by the at least one first suction inlet 13, the first high-pressure generation part 16 and the first discharge outlet 191, so after the air 3 is operated and propelled by the first fan 161, the generated first high-speed airflow 31 can be discharged from the first discharge outlet 191.

The inner shell body 2 is formed through a front shell 21 and a rear shell 22 being engaged so as to form a hollow member. The electric machine 17 is disposed on the backside of the rear shell 22. A protection cover 172 is used for covering the electric machine 17, and then the protection cover 172 is disposed at the backside of the rear shell 22 for protecting the electric machine 17. Wherein, the rear shell 22 is formed with at least one second through hole 221 corresponding to a location of the at least one second suction inlet 14 and communicated therewith, so that the air 3 is allowed to pass the at least one first through hole 121, the at least one second suction inlet 14 and the at least one second through hole 221 for reaching a second high-pressure generation part 23 (shown in FIG. 6) formed in the inner shell body 2, and the second high-pressure generation part 23 includes a second fan 231, for example an impeller or blades, used for enabling the air 3 to be formed as a second high-speed airflow 32.

The front end of the inner shell body 2 is formed with an annular second discharge outlet 261 allowing the second high-speed airflow 32 to be discharged, and a second airflow passage (shown in FIG. 6) is defined by the at least one second suction inlet 14, the second high-pressure generation part 23 and the second discharge outlet 261.

The second fan 231 is connected to another end of the output shaft 171 of the electric machine 17. As such, when the electric machine 17 is actuated, the first fan 161 and the second fan 231 are synchronously driven by the output shaft 171 for operations, and the first high-speed airflow 31 and the second high-speed airflow 32 are prevented from being interfered with each other.

For allowing an effect of centralizing the air 3 inside the inner shell body 2 to be achieved, a flow guiding cover 25 is disposed in front of the rear shell 22, the flow guiding cover 25 is formed with a flow guiding hole 251 oriented towards the second fan 231, so that the air 3 passing the at least one second through hole 221 can be centralized by the flow guiding hole 251 then be operated and propelled by the second fan 231, and the generated second high-speed airflow 32 can be discharged from the second discharge outlet 261.

As such, the first high-speed airflow 31 generated by the first high-pressure generation part 16 and passing the first airflow passage 19 is able to be linearly discharged from the first discharge outlet 191, and the second high-speed airflow 32 generated by the second high-pressure generation part 23 and passing the second airflow passage 26 is able to be linearly discharged from the second discharge outlet 261. Because the first high-speed airflow 31 and the second high-speed airflow 32 are both defined as active high-speed airflows, the first high-speed airflow 31 and the second high-speed airflow 32 can not only be linearly displaced, the displaced distance of the first high-speed airflow 31 and the second high-speed airflow 32 can also be substantially unified, thus a disadvantage of two airflows having different displaced distances can be solved, and an anticipated air circulation and cooling feelings can be achieved.

Moreover, for preventing a child from accidently being hurt by touching the second fan 231, the second discharge outlet 261 is provided with an isolation unit 4 which allows the second high-speed airflow 32 to pass; according to the first embodiment, the isolation unit 4 is a control box 41, the control box 41 is disposed on an inner wall of the front shell 21 and located at the second discharge outlet 261, so that an annular opening allowing the second high-speed airflow 32 to pass is reserved between the second discharge outlet 261 and the control box 41. Wherein, according to this embodiment, the control box 41 includes a display screen 411 capable of displaying information such as temperature, time or wind speed, if a touch screen is adopted as the display screen 411, at least one touch button 412 is further provided for controlling the ON/OFF status, the wind speed and the time, thereby providing more conveniences to a user.

Figure 7:
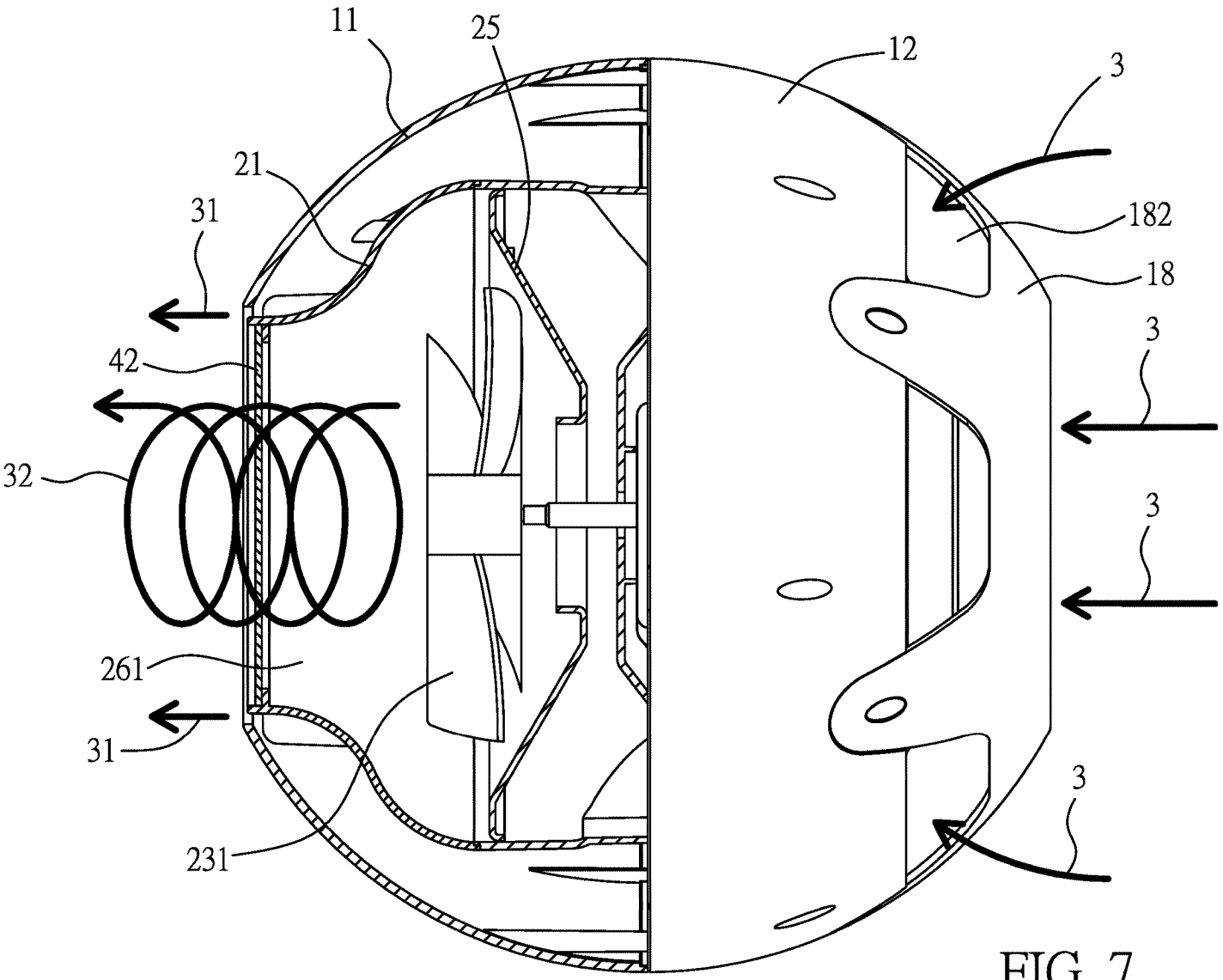
FIG. 7 is a cross sectional view showing the air blower according to a second embodiment of the present invention.

Please refer to FIG. 7, which is a second embodiment of the air blower provided by the present invention, the same codes adopted in this embodiment and the first embodiment are defined as the same components, because many of the components are shared by this embodiment and the previous embodiment, only the differences between this embodiment and the first embodiment are provided as follows: according to this embodiment, the isolation unit 4 is an isolation net 42 disposed at the second discharge outlet 261 for increasing the air output amount, and blades are adopted as the second fan 231, so that the blown second high-speed airflow 32 is formed in a vortex status.

Figure 8:
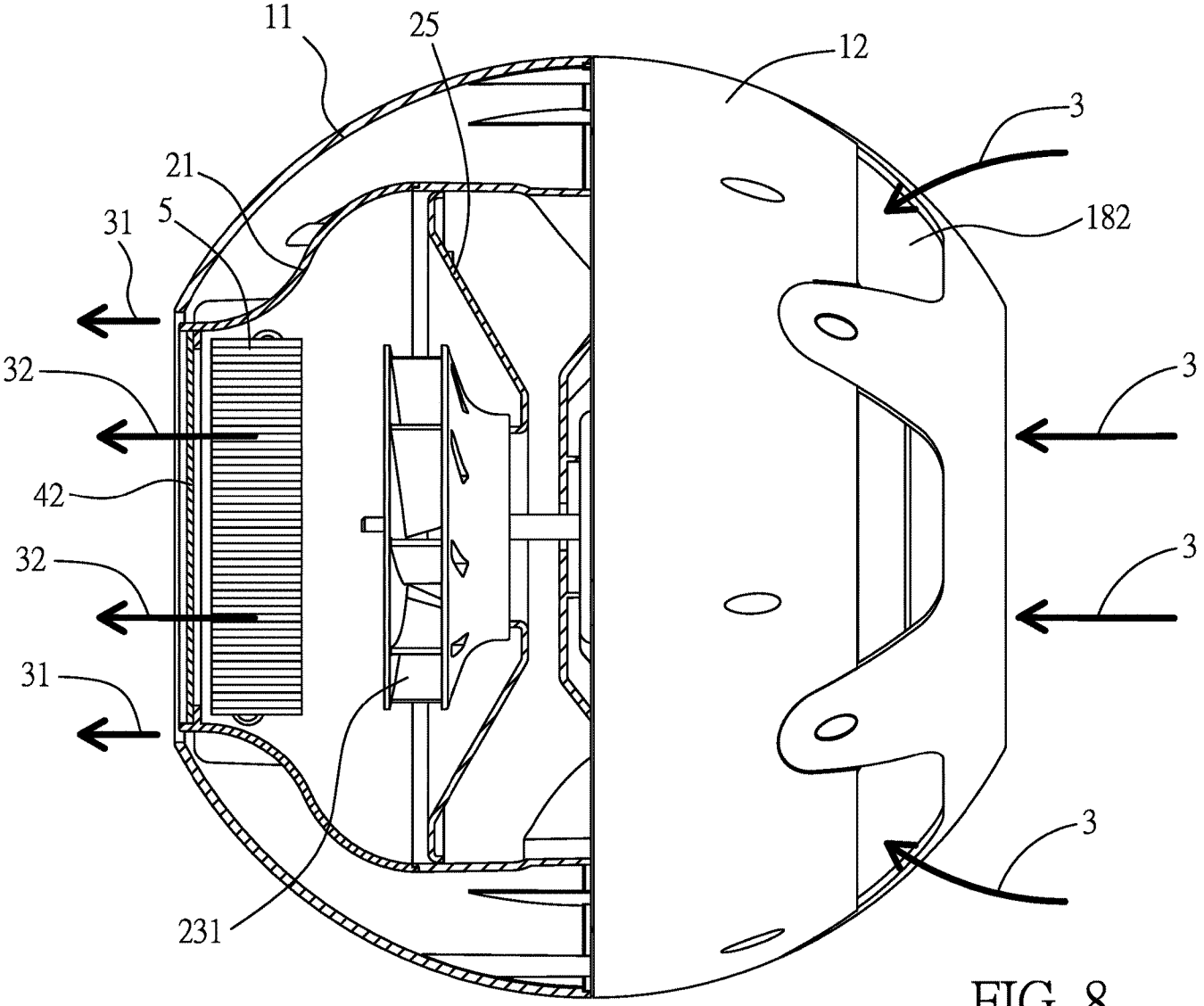
FIG. 8 is a cross sectional view showing the air blower according to a third embodiment of the present invention.

Please refer to FIG. 8, which is a third embodiment of the air blower provided by the present invention, the same codes adopted in this embodiment and the first embodiment are defined as the same components, because many of the components are shared by this embodiment and the previous embodiment, only the differences between this embodiment and the first embodiment are provided as follows: according to this embodiment, the isolation unit 4 is the above-mentioned isolation net 42 for increasing the air output amount, and an impeller is adopted as the second fan 231, so that the blown second high-speed airflow 32 is formed in a linear status, an electric heater 5 is disposed in the inner shell body 2 and arranged between the second fan 231 and the second discharge outlet 261 for allowing the air blower to be provided with a function of blowing warm air.

Based on what has been disclosed above, advantages achieved by the present invention are as follows: the first airflow passage and the second airflow passage spaced from each other and not interfering with each other are respectively formed between the outer housing and the inner shell body, and the first airflow passage having the first high-pressure generation part is able to generate the active first high-speed airflow, the second airflow passage having the second high-pressure generation part is able to generate the active second high-speed airflow, the active first high-speed airflow and the active second high-speed airflow can overcome a shortage of a passive low-speed airflow having overly short displaced distance, thereby enhancing the air circulation and air flowing effects; moreover, the first fan of the first high-pressure generation part and the second fan of the second high-pressure generation part are coaxially driven by the single electric machine, so that the whole volume of the air blower can be smaller. Accordingly, the air blower provided by the present invention is novel and more practical in use comparing to the prior arts.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An air blower, comprising an outer housing and an inner shell body disposed inside said outer housing;

wherein, said outer housing is formed with at least one first suction inlet and at least one second suction inlet used for sucking external air into an interior of said outer housing, a first high-pressure generation part is formed between said outer housing and said inner shell body, said first high-pressure generation part has a first fan capable of enabling said air to be formed as a first high-speed airflow, and an electric machine used for driving said first fan for operation, said first fan is connected to one end of an output shaft of said electric machine; an annular first discharge outlet allowing said first high-speed airflow to be discharged is formed between said outer housing and said inner shell body, and a first airflow passage is defined by said at least one first suction inlet, said first high-pressure generation part and said annular first discharge outlet; and said inner shell body includes a second high-pressure generation part communicated with said at least one second suction inlet, said second high-pressure generation part has a second fan capable of enabling said air to be formed as a second high-speed airflow, and said second fan is connected to another end of said output shaft of said electric machine; a front end of said inner shell body is formed with an annular second discharge outlet allowing said second high-speed airflow to be discharged, and a second airflow passage spaced from said first airflow passage is defined by said at least one second suction inlet, said second high-pressure generation part and said second discharge outlet;

wherein said at least one first suction inlet and said at least one second suction inlet are located on a first end portion of said air blower, and said annular first discharge outlet and said annular second discharge outlet are located on a second end portion of said air blower, said first end portion and said second end portion are located on opposing ends of said air blower;

wherein said first airflow passage is located between said outer housing and said inner shell body, and said second airflow passage is located within said inner shell body;

wherein said first airflow passage and said second airflow passage extend from said first end portion of said air blower to said second end portion thereof.

2. The air blower as claimed in claim 1, wherein said outer housing is formed through a front housing and a rear housing being engaged, said at least one first suction inlet is formed at a backside defined at the center of said rear housing, and said at least one second suction inlet is formed at an outer periphery of a middle partition mask disposed at an inner side of said rear housing.

3. The air blower as claimed in claim 2, wherein said middle partition mask is formed with at least one penetrated hole corresponding to a location of one of said at least one first suction inlet and communicated therewith and allowing said air to pass, so that said first high-pressure generation part is formed between said middle partition mask and said inner shell body.

4. The air blower as claimed in claim 1, wherein said first fan is selected from a group consisting of an impeller and blades, and said second fan is selected from a group consisting of an impeller and blades.

5. The air blower as claimed in claim 2, wherein said rear housing and said inner shell body are formed with at least one first through hole and at least one second through hole respectively, and said at least one first through hole and said at least one second through hole are connected with one of said at least one second suction inlet.

6. The air blower as claimed in claim 2, wherein a rear surface of said rear housing is further provided with an end cover, and said end cover is formed with at least one first air inlet corresponding to a location of one of said at least one first suction inlet, and is formed with at least one second air inlet corresponding to a location of one of said at least one second suction inlet.

7. The air blower as claimed in claim 6, wherein a filter capable of filtering said air entering said interior of said outer housing is disposed between said end cover and said rear housing.

8. The air blower as claimed in claim 1, wherein said inner shell body is formed through a front shell and a rear shell being engaged, a flow guiding cover is disposed in front of said rear shell, and said flow guiding cover is formed with a flow guiding hole oriented towards said second fan and allowing said air to pass.

9. The air blower as claimed in claim 8, wherein said electric machine is disposed on a backside of said rear shell, a protection cover is used for covering said electric machine, and said protection cover is disposed at said backside of said rear shell.

10. The air blower as claimed in claim 1, wherein said second discharge outlet is provided with an isolation unit allowing said second high-speed airflow to pass.

11. The air blower as claimed in claim 10, wherein said isolation unit is a control box, said control box is disposed on an inner wall of said inner shell body and located at said second discharge outlet, so that an annular opening allowing said second high-speed airflow to pass is reserved between said second discharge outlet and said control box.

12. The air blower as claimed in claim 10, wherein said isolation unit is an isolation net disposed at said second discharge outlet.

13. The air blower as claimed in claim 1, wherein an electric heater is disposed in said inner shell body and arranged between said second fan and said second discharge outlet.

* * * * *